United States Patent [19]

Egee

[11] Patent Number: 4,539,879

[45] Date of Patent: Sep. 10, 1985

[54] METHOD AND APPARATUS FOR FORMING AND PROCESSING FOOD SPEARS

[75] Inventor: Walter W. Egee, Wallingford, Pa.

[73] Assignee: Campbell Soup Company, Camden, N.J.

[21] Appl. No.: 397,881

[22] Filed: Jul. 13, 1982

[51] Int. Cl.[3] ..... B65B 35/40; B65B 35/56

[52] U.S. Cl. ..... 83/107; 53/515; 83/164; 83/278; 83/425.3; 198/390; 198/417

[58] Field of Search ..... 83/105, 106, 107, 719, 83/720, 723, 724, 163, 165, 199, 164, 404.1, 404.2, 404.3, 437, 425, 425.3, 278; 198/390, 417; 53/515, 544

[56] References Cited

U.S. PATENT DOCUMENTS

| | | | |
|---|---|---|---|
| 3,461,646 | 8/1969 | Lane et al. | 53/515 |
| 3,468,098 | 9/1969 | Eisenberg | 53/515 |
| 3,662,518 | 5/1972 | Eisenberg | 53/515 |

*Primary Examiner*—Frank T. Yost
*Assistant Examiner*—Hien H. Phan
*Attorney, Agent, or Firm*—Albert L. Free

[57] ABSTRACT

Cucumber spears are rapidly and reliably packed into and around the inner periphery of a jar with the same cut side of each of the spears facing outwardly. The spears are formed by pushing a cucumber lengthwise through a set of knife blades, and the resultant spears are individually pushed through twisted channels by flexible rods which deliver them onto a horizontal platform with their cut sides down and all facing the same way. Two conveyor belts are recessed in the top of the platform, so that by lowering the platform the set of spears is deposited on the conveyor belts and conveyed downstream to a pair of adjacent platens each having grooves aligned with the conveyor belts. A fence across the conveyor arrests a first set of spears above the first platen, which is then raised to lift the first set of spears from the conveyor, whereupon a second set of spears accumulate above the second platen. The second platen is then raised to form with said first set a single array of contiguous spears which is subsequently pushed onto a roll-up belt, rolled into a cylindrical array, and pushed into the jar.

15 Claims, 38 Drawing Figures

100
111
110
202
120
114
20
96
136
144
140
92
166
126
116
90
98
180
184
182
118
190
10.
9.
8.
186
185
183

20a
20b
20c
20d
20e
20f
32

1
2
3
4
5

METHOD AND APPARATUS FOR FORMING AND PROCESSING FOOD SPEARS

BACKGROUND OF THE INVENTION

This invention relates to method and apparatus for automatically packing elongated food products into containers, and to such method and apparatus for forming the food spears and for automatically conveying them into the proper positions, in the proper orientations, and in the proper quantities for accomplishing such packing.

There are a variety of applications in which it is desired to pack elongated bodies of food, or food spears, into a container, automatically rather than by hand. One example of this, in connection with which the present invention will be described, is in the packing of cucumber spears into a jar for subsequent retail sale. One form of method and apparatus useful for this purpose is described and claimed in U.S. Pat. No. 4,453,368, issued June 12, 1984, filed Apr. 30, 1982 and entitled Method and Apparatus for Automatically Packing Elongated Food Articles in Controlled Positions and Orientations. In the operation of the latter form of apparatus, cucumbers are cut into spears and the resultant spears delivered skin-side-down onto a first conveyor belt. This belt delivers the spears to another conveyor belt, and in so doing causes the spears to topple over from their skin-side-down orientations into cut-side-down orientations on the second conveyor belt. A fence or stop extends across, and just above, the latter belt, to arrest the first spear reaching it, and the subsequent spears accummulate against the rear of the first spear and against each other, until an array of spears has accumulated which is of a length suitable to fit closely about the inner periphery of the container when packed therein. The accumulation of this desired length of horizontal array of spears on the second belt is sensed, and the horizontal array of spears pushed onto a flat, horizontal roll-up belt or band of flexible material, by means of a pusher bar.

The roll-up band with the array of spears on it is then automatically rolled up into a cylindrical form, the spears forming a ring within the band, with their cut sides outermost. Next a reciprocable pusher is automatically actuated to push the ring of spears out of the rolled-up band and through the open neck of a glass jar positioned adjacent one end of the spears, wherein they dispose themselves about the interior periphery of the jar with the same cut side of each spear facing outwardly, as desired for best product display. The spears lock themselves into position in the jar so that the hollow ring which they form in the jar does not collapse. The empty roll-up band is then unwound into its flat configuration, and the cycle repeated to fill the next jar. If desired, additional spears may be manually packed into the center of each jar, within the previously packed ring of spears.

While this apparatus functions for its intended purpose, like all machines it is open to improvement. First, in the order of operations, while the spears may be caused to slide downwardly by gravity from the exit end of a cutter through twisted channels onto the first conveyor belt, various of the spears may not traverse the channels at the uniform high speed which is desired, particularly where the cucumbers may differ somewhat in size.

Secondly, the toppling of the spears from the skin-side-down to the cut-side-down positions may not always occur uniformly, especially when different sizes of spears are used and/or the belt is run at somewhat different speeds.

Thirdly, when a relatively large number of spears (e.g. 10) are to be accumulated in a stationary position on the moving second belt by means of the abovementioned fence, there is sometimes a tendency for the later-arriving spears of a group, e.g. those in the last five of a group of ten, to assume final positions on the second conveyor belt which are other than their desired positions parallel to, transversely aligned with, and immediately next to, the spears adjacent to them, as they should be for reliable transfer to the roll-up band and thence into the jar or other container.

Accordingly, it is an object of this invention to provide a new and useful method and apparatus for forming of food spears and for packing them into containers.

Another object is to provide such method and apparatus which is of improved reliability, especially when used at high speeds.

A further object is to provide a new method and apparatus in which reliable and accurately timed delivery of food spears from a spear-former to a support is accomplished, while assuring that the spears will be in predetermined orientations about their longitudinal axes upon delivery to the support.

A further object is to provide a new method and apparatus for depositing food spears onto, or lifting them from, a conveyor.

Another object is to provide a method and apparatus which assures the proper arrest and accumulation of relatively large numbers of food spears on a moving conveyor, so as to enable formation of a stationary spear array of predetermined length, in which array the spears are positioned parallel and substantially contiguous to each other.

SUMMARY OF THE INVENTION

These and other objects of the invention are achieved by the provision of a food spear forming and handling method and apparatus which preferably comprise all of the following general features in combination, although the invention may be practiced and some of its advantages achieved by utilizing only one, or less then all, of these features.

According to one preferred feature of the invention, the food spears are delivered to channel means comprising a set of spear-guiding channels, one for each of the respective spears, and pusher means are provided which are adapted to extend into the channels and to push each of the spears through its respective channel, into proper position on a suitable spear-supporting means. Preferably the pusher means comprise a plurality of flexible rods, one for each channel, which are reciprocable together so as to push the spears through their respective channels onto the supporting means simultaneously. This arrangement provides positive, quick delivery of the spears through the channels onto the support means at accurately controllable times, and in the desired orientations. In a preferred embodiment, the channels are openings extending through a common body of material, and are twisted and positioned to deliver the spears onto the support means in a horizontal row with the same corresponding cut sides of the spears facing downward.

According to another preferred feature, spears are deposited on and/or lifted from a conveyor means by an arrangement comprising a vertically-positionable support means having one or more recesses in its upper surface of a width and depth sufficient to contain said conveyor means with the top of said conveyor means below the top of said support when said support is in a raised position, the top of said conveyor means being above the top of said support means when said support means is in its lowered position. Accordingly, food spears placed on the support means in its raised position may be transferred to the conveyor means by lowering the support means; or, food spears on the conveyor means may be transferred to a support means by moving the support means to its raised position.

According to another preferred feature, two independently raisable and lowerable platens or platforms are provided adjacent each other along the conveyor, so constructed and arranged with respect to the conveyor that in their lowered positions they permit the spears to be conveyed downstream until a fence positioned across and above the conveyor arrests the first spear of a group and thereby causes subsequent spears of that group to accumulate behind the first spear, adjacent to each other; to this extent the operation is similar to that of the above-referenced system of the prior art. However when a part, such as one-half, of the number of spears to be packed in a jar has thus been accumulated, the first or downstream platen is raised to lift the so-far accumulated spears of the group upward from the conveyor so that they rest upon the top of the first platen at least momentarily. This raising of the first platen causes the first spear of the remainder of the group to be a rested at the upstream edge of the first platen, and causes the remaining spears of the group to accumulate behind, and next to, the latter first spear. When the entire remainder of the group has thus accumulated, the second platen is raised to lift the second part of the group of spears upward from the conveyor into a position horizontally aligned with the previously accumulated spears of the first part of the group and immediately next to them, so as to form the desired compact array ready to be pushed onto the roll-up band for roll-up into a ring configuration, and for subsequent pushing from the rolled-up band into the jar. With this arrangement, only a portion of the group of spears to be packed in a jar is subjected to the arresting and accumulating process at any given time; typically, first one-half (e.g. 5) of the group is arrested and lifted by the first platen, and then the other half (e.g. 5) of the group is arrested and lifted by the second platen. Because of this, there is much less tendency for an occasional spear to become mispositioned during the arrest and accumulation process than when the entire group (e.g. 10) is arrested and accumulated in one operation, as in the previously described system. The dimensions of the first and second platens are also preferably chosen so that at least the downstream platen, and preferably both platens, hold exactly the length of spear array which it is intended to receive. Preferably each of the platens utilize the above-described configurations of support means, using one or more recesses or grooves in its upper surface for enabling the top of the platen to be positioned below the conveyor during the spear-arresting process and to be raised above the top of the conveyor when the array of spears is to be supported free of the conveyor, for subsequent pushing onto the roll-up band.

BRIEF DESCRIPTION OF FIGURES

These and other objects and features of the invention will be more readily understood from a consideration of the following detailed description, taken with the accompanying drawings, in which.

DETAIL DESCRIPTION OF SPECIFIC EMBODIMENTS

Figure 1:
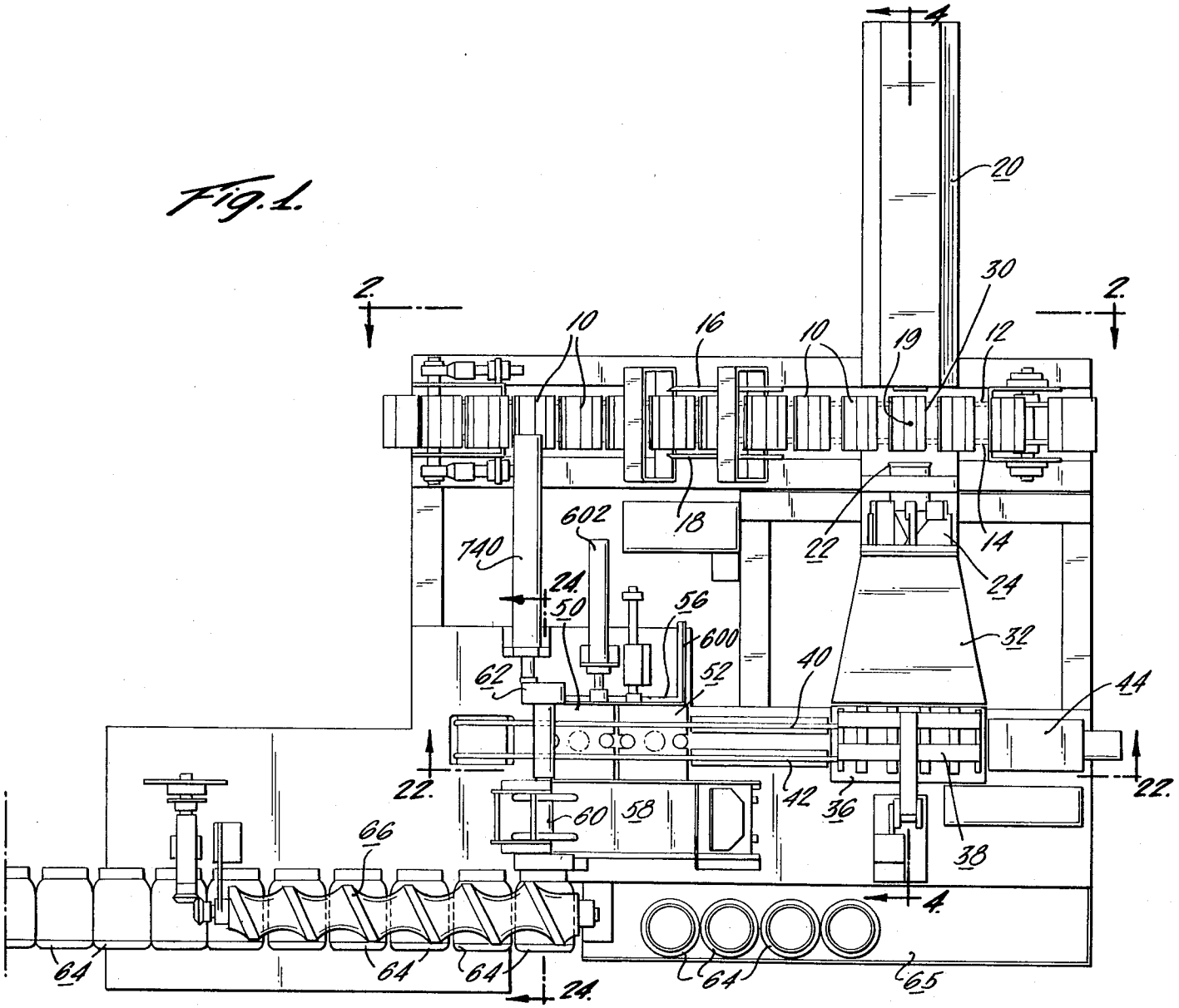
FIG. 1 is a plan view showing the general organization of a preferred system in accordance with the invention.

Referring now to the overall plan view of the apparatus as shown in FIG. 1 as used for packing cucumber spears into a jar, by way of example only and without thereby in any way limiting the scope of the invention, in the overall operation of the system whole cucumbers may be manually or automatically loaded, one into each of the carriers such as 10 which are mounted on a conventional pair of endless conveyor chains 12 and 14. The cucumbers are loaded into the carriers with their opposite ends protruding therefrom, and a pair of fixed knives 16 and 18 are mounted on opposite sides of the path of the carriers to cut off opposite ends of the cucumbers as they pass by, so that the remainder of the cucumber constitutes an integral food product of known predetermined length. Preferably the cucumbers have been pregraded and selected to have sizes within a predetermined range compatible with the selected parameters of the system.

A conventional intermittent drive (not shown) for the carrier conveyor chains moves the carriers and cucumbers successively into a fixed position 19 between a pusher mechanism 20, aligned with one end of the cucumber and with a cucumber centering device 22 at the other end of the cucumber, as will be described hereinafter in detail. The pusher mechanism is reciprocable so as to push a cucumber such as 30 through the centering device 22 and the knife means 24, thereby to cut the cucumber into a plurality of elongated food spears 26 of sector-shaped cross-section, in this example five such spears for each cucumber.

The forward ends of the spears produced by the knife means 24 are aligned with a corresponding number of channels in the channel means 32, and the pusher mechanism 20 includes pusher rods described hereinafter which extend into the channels and push each of the spears positively through the channels and slide them onto a horizontal platform 36. The channels in the channel means 32 are twisted about their longitudinal axes so that the spears, as they travel through the channels, are themselves turned about their longitudinal axes to be delivered onto the platform 36 in desired angular orientations, in this example with the same corresponding cut face downward and in contact with the top of the platform 36.

In this preferred embodiment, the spears emerging from the channels are guided into their desired parallel relationships on platform 36 by a pivotable guide means 38 which provides a plurality of vertically-walled stalls, one for each of the spears. After the spears have thus been guided into their desired positions on the platform 36, the guide means 38 can be pivoted upwardly so that the spears are free of the stalls and can be moved sideways from the platform.

As will also be described in detail hereinafter, the platform 36 is vertically positionable, and has a pair of grooves extending longitudinally completely across it transverse to the spears; with the platform 36 in its raised position which it occupies at this phase of operation, a pair of spear-conveyor belts 40 and 42 used to convey the spears away from the platform are completely recessed within these grooves.

In this embodiment a compactor 44 is preferably employed adjacent the platform 36 which, when the guide means 38 is raised, executes a cycle of operation to push the spears together into a more compact row. It will be appreciated that, as in the system described in the above-identified copending application, such compacting is not always necessary since the arresting of the spears causes them to accumulate next to each other even if originally spaced apart.

The conveyor belts 40 and 42 are disposed in a conventional endless belt configuration, and each may typically comprise a plastic cable of small circular cross section. In this embodiment the conveyor belts may run continuously during normal operation, so that when the guide means 38 has been pivoted upwardly out of the way and the compactor 44 has completed its operation, the platform 36 can be lowered and the cucumber spears thereby deposited upon the conveyor belts and conveyed downstream, to the left in FIG. 1, each spear lying across and spanning the distance between the conveyor belts.

Figure 24:
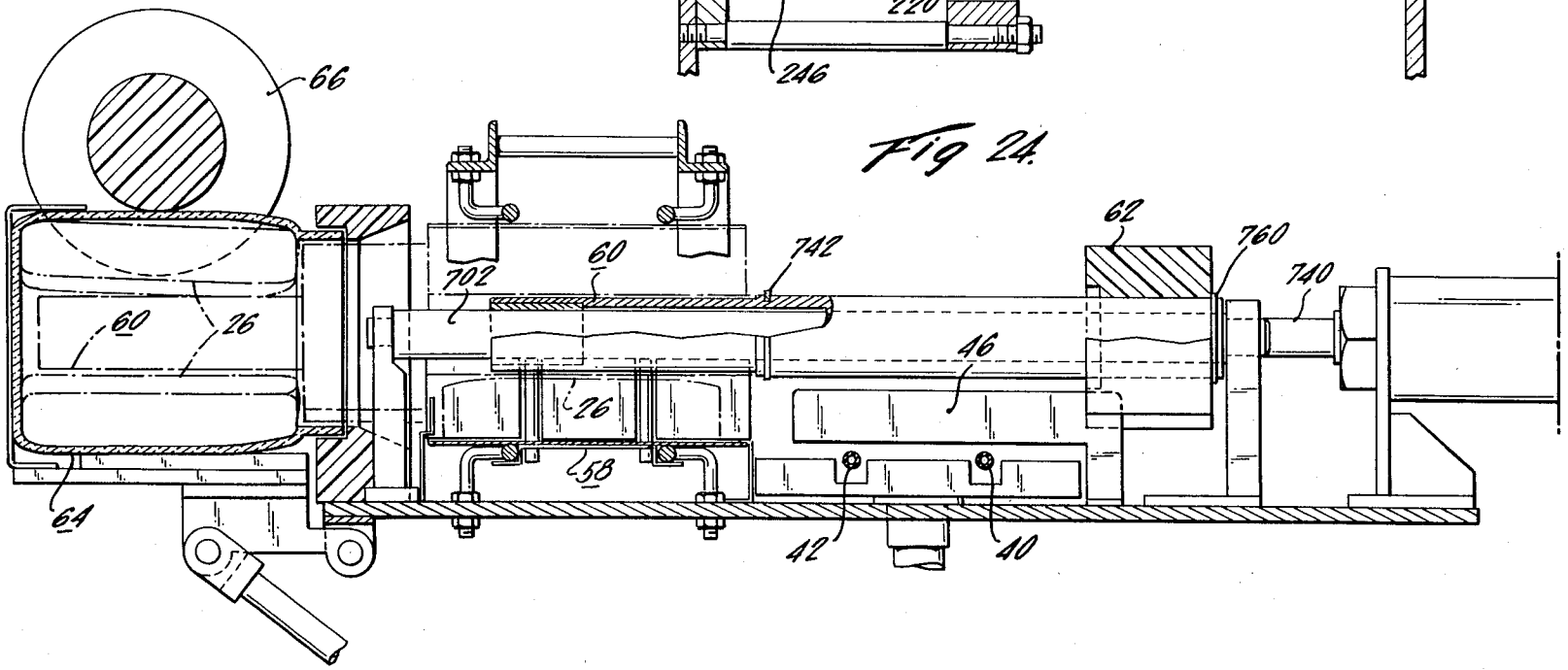
FIG. 24 is a vertical sectional view taken along lines 24—24 of FIG. 1, showing the arrangement for rolling-up the spears inside a belt and for pushing them from the belt into a jar; and, FIGS. 25*a* to 25*i* are schematic views illustrating successive stages in a typical operation of the conveying system.
Figure 22:
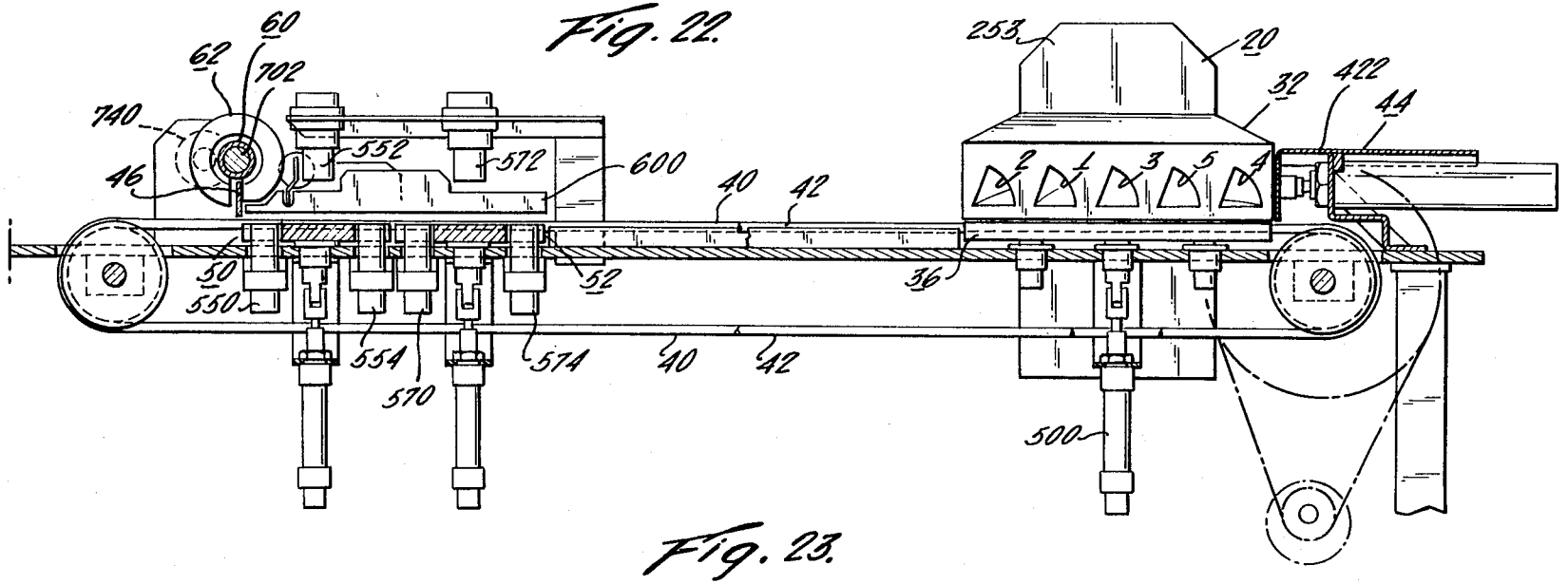
FIG. 22 is a side view taken along lines 22—22 of FIG. 1, showing especially the spear-conveying arrangement.
Figure 23:
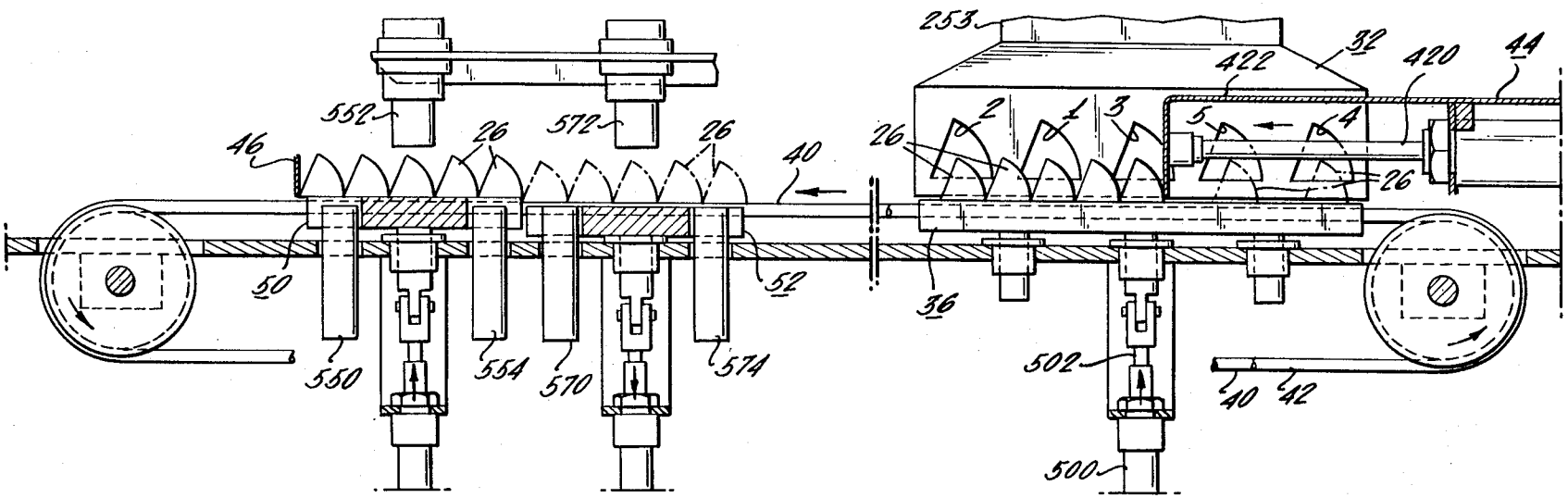
FIG. 23 is an enlarged fragmentary side view of portions of the apparatus of FIG. 22, showing the compactor at the end of its forward stroke, and showing the position of the spears during operation.

Downstream of platform 36 there is located a fence 46 shown in FIGS. 22, 23 and 24 which extends across the conveyor belts and which is spaced slightly above them, so as to arrest the arriving spears. As described in my above-identified copending application, when the first spear of a group has thus been arrested, the other spears of the group will also be arrested and accumulate just behind it, in parallel contiguous relationship to each other.

Adjacent the upstream side of fence 46 and below the conveyor belts 40 and 42 are two adjacent vertically positionable platforms or platens 50 and 52, each having grooves across their entire lengths in alignment with the conveyor belts, so that the platens can be moved from a lowered position in which the tops of the belts are above the tops of the platens to a raised position in which the tops of the platens are above the tops of the conveyor belts. In this example, sensor means are provided to indicate when the first five spears have been accumulated on the conveyor above the first platen 50, and at this time the first platen is automatically raised to lift the first accumulated five spears upwardly, free of the conveyor belt, so they are supported on the first platen, the conveyor belts at this point being recessed in the grooves of the platen.

In this position, the upstream side of the raised first platen 50 arrests the next spear from the next cucumbers to arrive on the conveyor, so that it stops on the conveyor belt at the downstream end of the platen 52, which is at this time still in its lowered position. The other four spears from that next cucumber will then accumulate behind the first spear in contiguous parallel relationship to each other, directly above the second platen 52. Appropriate sensors provide indications of when all five spears have thus been accumulated, and automatically cause the second platen 52 to move it to its raised position, whereby the second five spears are lifted free of the conveyor belts and supported on the top of platen 52. Platen 52, when in its raised position, has its top surface aligned horizontally with the top surface of the first platen 50, so that the two sets of five spears are then aligned horizontally and next to each other to form a complete horizontal array of ten spears in contiguous parallel configuration on the two aligned platens.

When the upstream platen 52 has reached its raised position, a pusher 56 is automatically caused to execute a cycle of operation, in which it moves forwardly from its normally retracted position shown in FIG. 1, so as to push the array of spears onto the roll-up belt 58, whereupon the pusher returns to its normal retracted position.

Roll-up belt 58 and its drive arrangement may be as shown and described in my above-referenced copending application, particularly in the last sheet of drawings thereof, and hence need not be described in detail. In general, the roll-up belt 58 with the ten contiguous parallel spears positioned thereon is urged forwardly, to the left in FIG. 1, along a cylindrical path, so that the belt and spears are rolled up into a cylindrical array about central mandrel 60. A centrally apertured ring-shaped pusher 62 is then automatically advanced to push the annular array of spears out of the rolled-up belt and into the waiting jar 64. The jars such as 64 may be advanced automatically into their receiving positions by means of a screw conveyor 66 and, after being filled with spears turned vertically and delivered to a discharge jar conveyor 65. This mechanism for delivering, turning and discharging the jars may be the same as that shown and described in my above-referenced application, and hence need not be dislcosed further herein, the disclosure of my above-identified application being included by reference.

It will therefore be appreciated that, during the operation of the above-described system, each cucumber is cut into spears, the spears delivered through respective twisted channels into the desired cut-side-down positions on the platform 36, transferred from a platform 36 to a conveyor consisting of belts 40 and 42, and moved downstream by the conveyor belts 40 and 42 until the first spear encounters the fence 46, whereupon the spears accumulate into a first subgroup above the platen 50; the platen 50 is then raised to lift the five spears from the conveyor belts. The next five spears from the next cucumber, which are cut, delivered to the upstream platform, and deposited on the conveyor belts in the same manner, then accumulate above the platen 52, which is then raised so as to provide the desired array of ten spears, all similarly oriented with the cut-side-down, parallel and contiguous to each other. This entire array of ten spears is pushed onto the wrap-up belt, wrapped up into a cylindrical configuration, pushed out of the wrap-up belt into the waiting jar, and the jar turned and discharged.

As will be described in detail, the pushing of the individual spears through the channel means 32 is accomplished by individual flexible rods each of which advances through a different one of the channels at a predetermined time, whereby the spears are delivered rapidly and at controlled times onto the platform 36. The grooved platen and platform arrangements enable convenient and easily-controlled transfer of spears to and from the conveyor belts as described above, and the use of the two downstream platens 50 and 52, independently positionable along a vertical direction, makes it necessary for the downstream fence to collect only one-half of the ten spears at a time by the spear-arresting process described, thus reducing and substantially eliminating any tendency for spears in the second group of five to accumulate improperly, in undesired positions or orientations as may sometimes happen if all ten are accumulated in the same arresting process.

Figure 2:
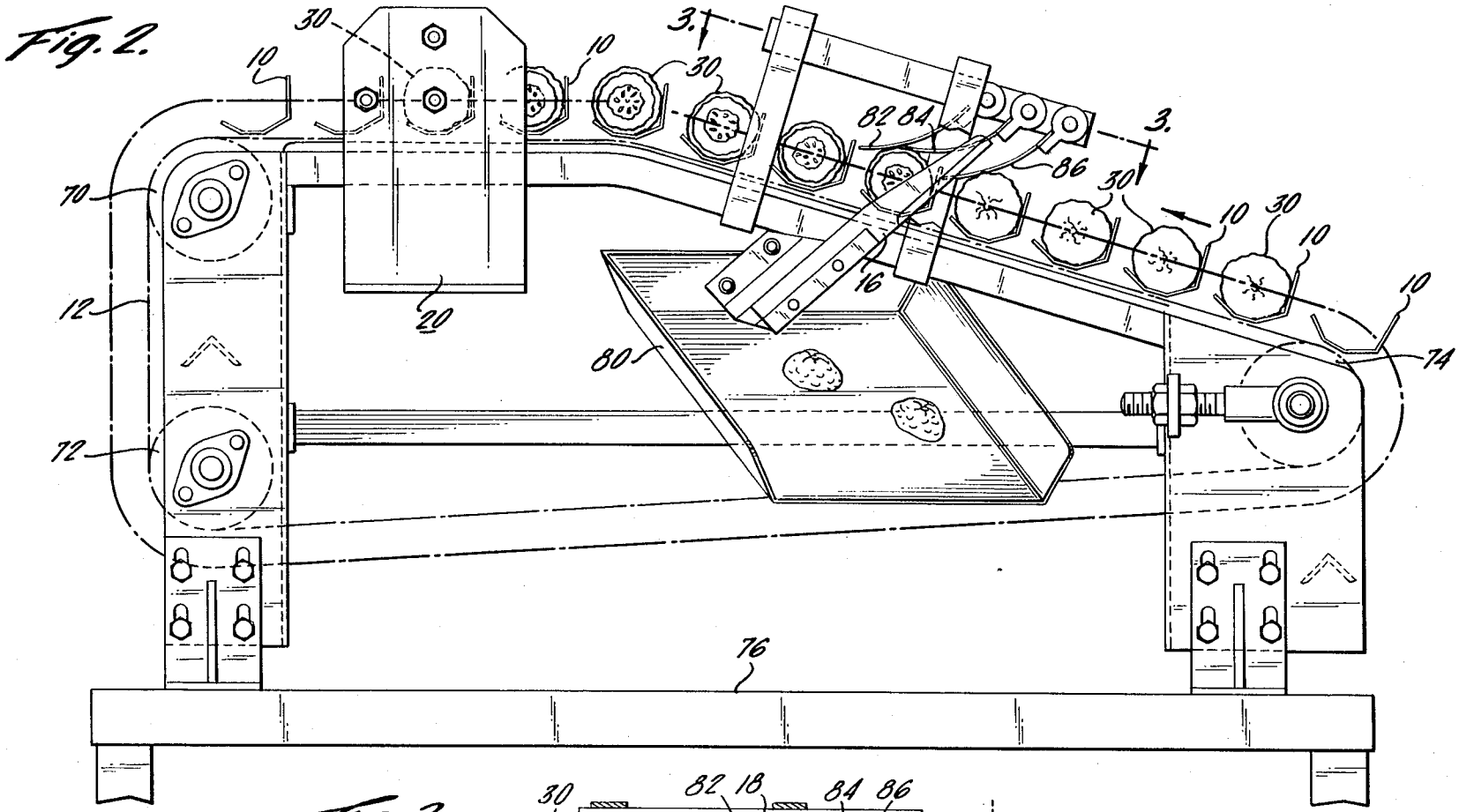
FIG. 2 is a rear view, taken along lines 2—2 of FIG. 1, of the portion of said system by means of which the ends of the cucumber spears are trimmed to size and the trimmed cucumbers conveyed successively into a stationary position for cutting into spears.
Figure 3:
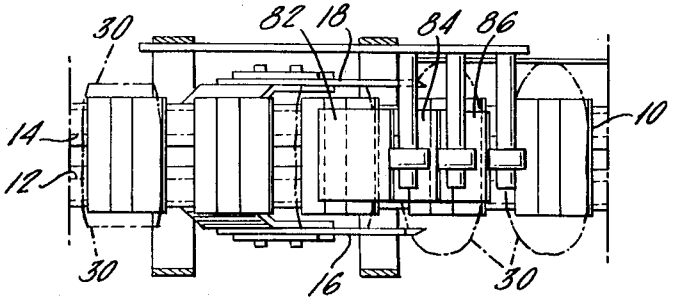
FIG. 3 is a view taken along lines 3—3 of FIG. 2, showing especially the knife arrangement for trimming the ends of the cucumbers.

Referring now to the detailed drawings which show more clearly one preferred form of various components of the system of FIG. 1, FIG. 2 is a rear view of the whole-cucumber conveyor, showing the cucumber carriers such as 10 mounted on the endless chain belts 12, 14, which in turn pass over the chain-drive sprocket devices 70, 72 and 74 mounted on a suitable base 76. The carriers are positioned along the entire lengths of the chains, and are loaded with cucumbers at the right-hand side of the conveyor as viewed in FIG. 2. By means of an intermittent chain drive (not shown), the carriers and cucumbers 30 are moved successively into the spear-cutting position shown at 19. The fixed knife blades 16, 18 for trimming the whole cucumbers to size are associated with a chute 80 which catches the cut-off ends of the trimmed cucumbers. In order to hold the cucumbers tightly while their ends are being cut off, the three sheet-spring members 82, 84 and 86 are preferably provided, which bear against the cucumbers as they pass through the end-trimming station and hold them securely in place against the carriers.

Figure 21:
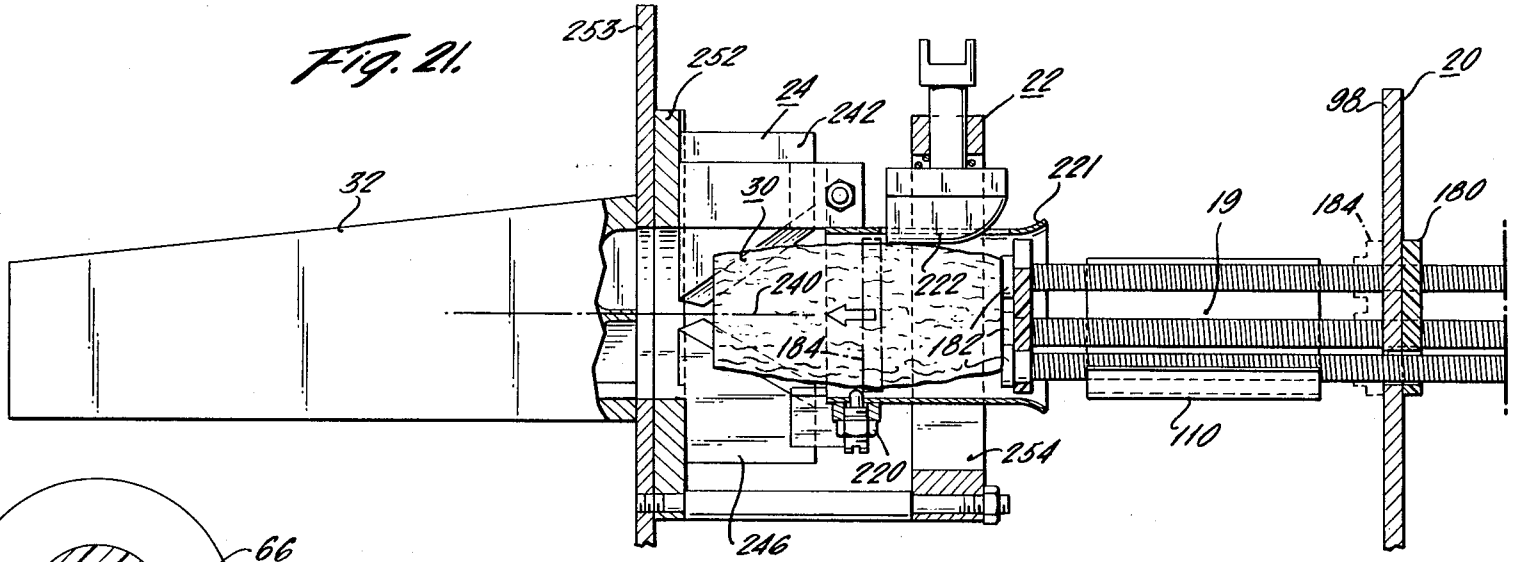
FIG. 21 is an enlarged fragmentary side view, largely in section, of a portion of the apparatus of FIG. 4, showing a cucumber being pushed through the knife means to form spears therefrom.

FIGS. 4–15 show especially clearly the pushing and cutting arrangement for dividing the integral cucumbers into five spears 26 of sector-shaped cross-section, and FIG. 21 shows the beginning of the spear-cutting action in an even more greatly enlarged view. Referring especially to these figures, in FIGS. 4 and 5 the pusher mechanism is shown in its fully retracted state, with the cucumber 30 which is to be cut into spears positioned directly in front of the pusher mechanism 20. The pusher mechanism comprises a supporting frame 90 on which are mounted three horizontal, parallel support bars 92, 94 and 96, extending between and secured to end plates 98 and 100. The central support bar 96 is aligned with the axis of the cucumber 30 which is to be pushed through the knife blades. A rear supporting disc 110 having a centrally and axially extending bearing 111 is mounted to slide freely along the three support bars 92, 94 and 96 in a reciprocating manner and, to secure such reciprocating action, disc 110 is secured by an appropriate bracket arrangement 114 to a small diameter cable 116 which extends about the pulleys 118 and 120; the cable is driven back and forth along its axis by an air cylinder 126 to reciprocate the disc 110 correspondingly.

Mounted on the forward side of disc 110, as by welding, are five rigid, horizontal, parallel, pusher rods 130, 132, 134, 136 and 138. As shown especially clearly in FIG. 11, these rods are spaced equiangularly about the central support bar 96, and toward their forward ends they are supported in front support disc 140. While the rods 130–138 are fixedly secured to the rear support disc 110, disc 140 rides freely over supports bars 94 and 96, and is in slideable frictional engagement with support bar 92; by means of a bushing portion 144 extending along rod 92 so as to assure proper alignment of front support disc 140 at right angles to the support bars. While disc 140 can slide over the support bars 92–96, as well as over the solid pusher rods 130–138, it is restricted in its rearward motion by a small disc-like stop member 150 on support bar 94.

Figures 6, 7, 8, 9, 10:
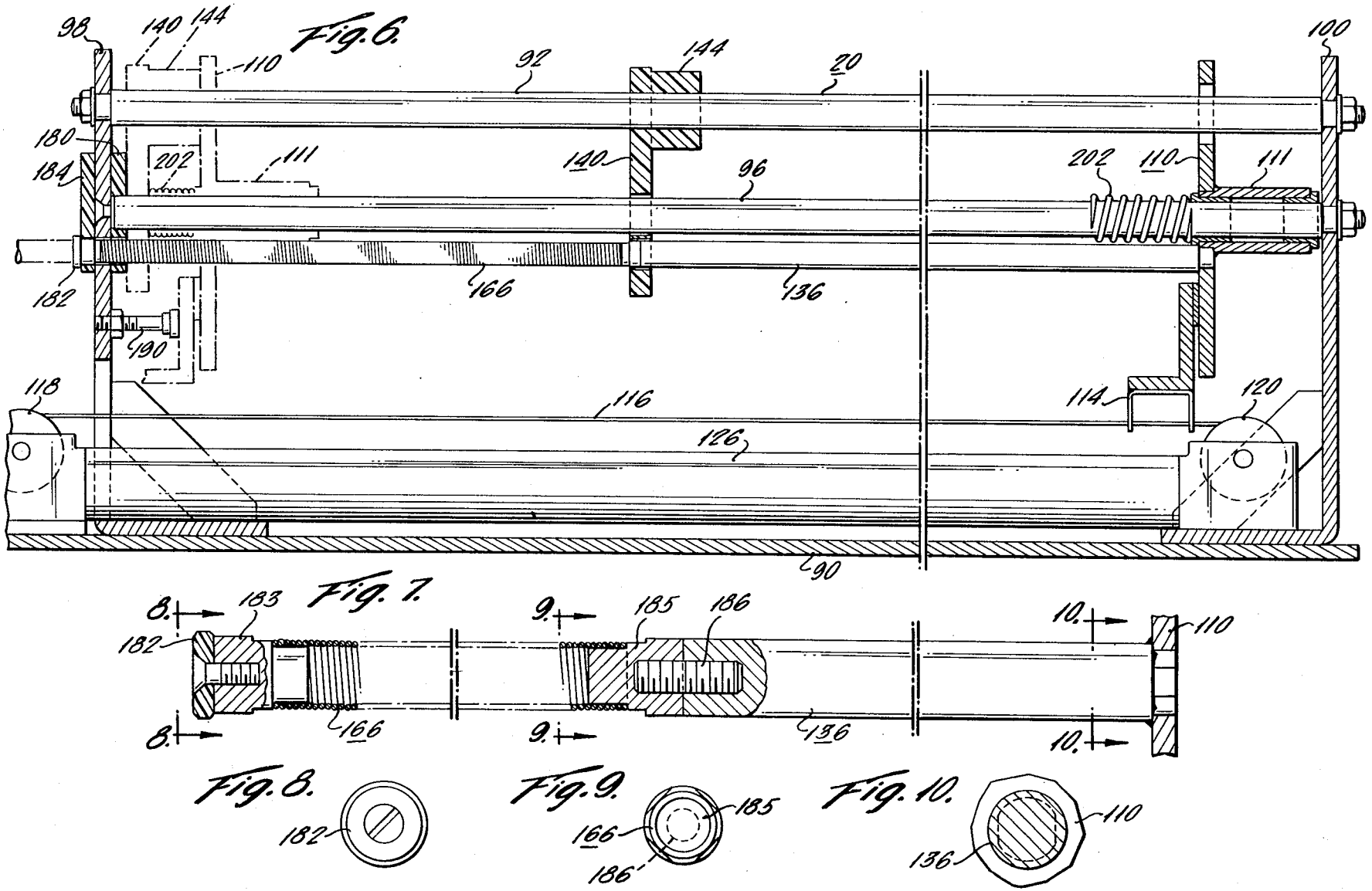
FIG. 6 is a sectional view taken along lines 6—6 of FIG. 5.
FIG. 7 is a enlarged side view, partly in section, of one of the pusher rods of FIG. 6.
FIGS. 8–10 are sectional views taken along lines 8—8, 9—9 and 10—10 of FIG. 7, respectively.
Figure 11:
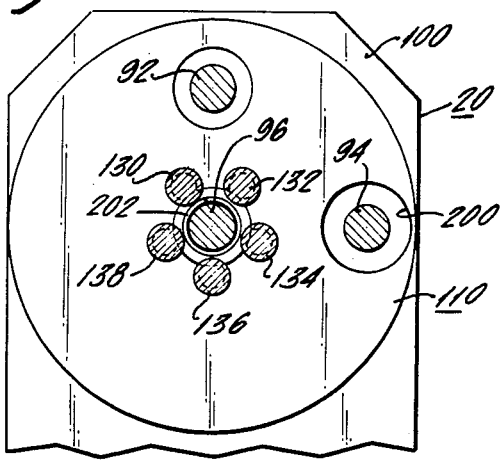
FIG. 11 is a sectional view taken along lines 11—11 of FIG. 4.
Figure 12:
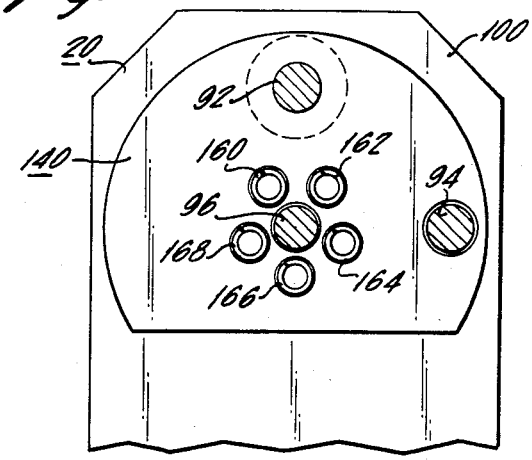
FIG. 12 is a sectional view taken along lines 12—12 of FIG. 4.
Figure 13:
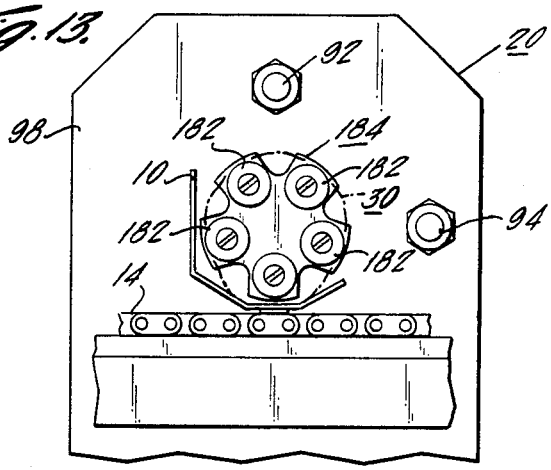
FIG. 13 is a sectional view taken along lines 13—13 of FIG. 4.
Figure 14:
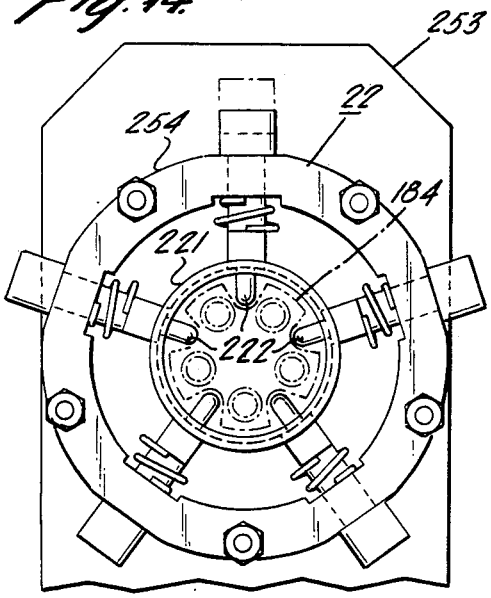
FIG. 14 is a sectional view taken along lines 14—14 of FIG. 4.
Figure 15:
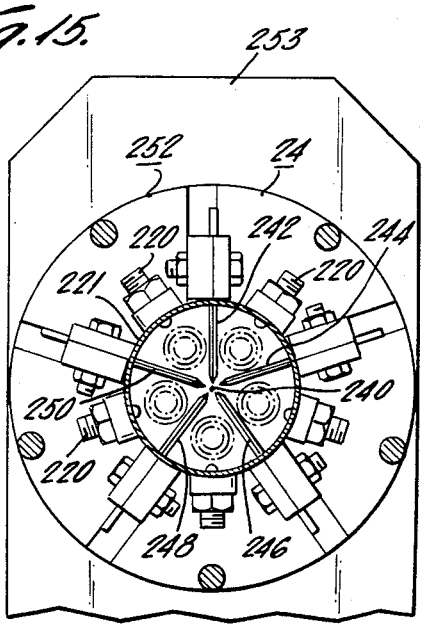
FIG. 15 is a sectional view taken along lines 15—15 of FIG. 4.

Mounted on the forward ends of the solid pusher rods are the flexible pusher rods 160, 162, 164, 166 and 168. In this embodiment, the flexible pusher rods are formed by tightly wound spiral spring wires (see especially FIGS. 6–10), which pass through corresponding loosely-fitting circular openings in a disc-like bushing 180 mounted on the front end plate 98. Each of the flexible rod members is provided at its forward end with a small button-like disc such as 182 (see especially FIGS. 7 and 8) screwed to a corresponding insert such as 183, which in turn is securely pressed into the interior of the forward end of the corresponding flexible pusher rod such as 166. As shown in FIGS. 7 and 9, each flexible rod is secured to the corresponding rigid rod such as 136 by means of an insert such as 185 and a screw 186. A rod-restraining disc 184 contains five openings which surround and are in slideable frictional engagement with the five respective flexible rod members; the button-like discs 182 prevent the restraining disc 184 from moving off the forward end of the flexible rod members and provide appropriate surfaces for pushing against the cucumbers without marring them. If desired, a tightly-fitting flexible sleeve may be placed over each rod.

A stop 190 is mounted on the rearward side of the front end plate 98, extending rearwardly to a position at which it arrests forward motion of the bracket arrangement 114 secured to the rear supporting disc 110 when the latter disc is advanced during its reciprocating stroke.

Figure 5:
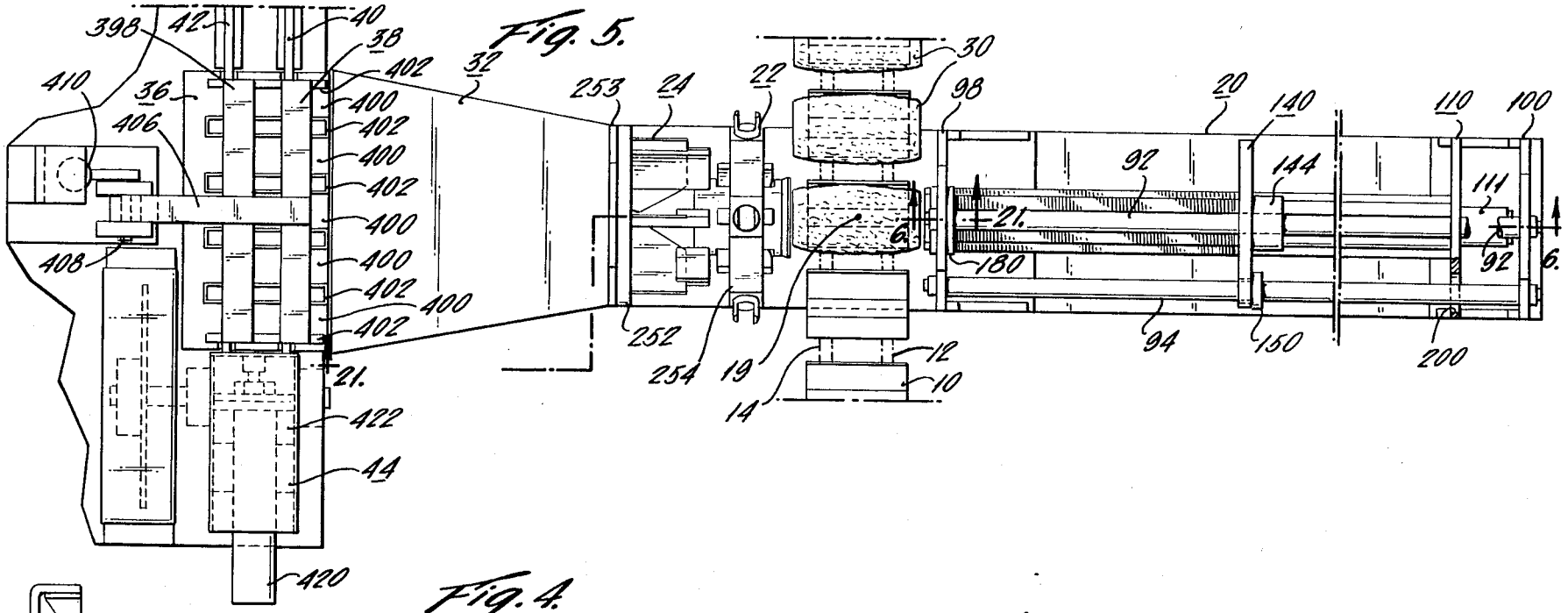
FIG. 5 is a top view of the apparatus shown in FIG. 4.
Figure 4:
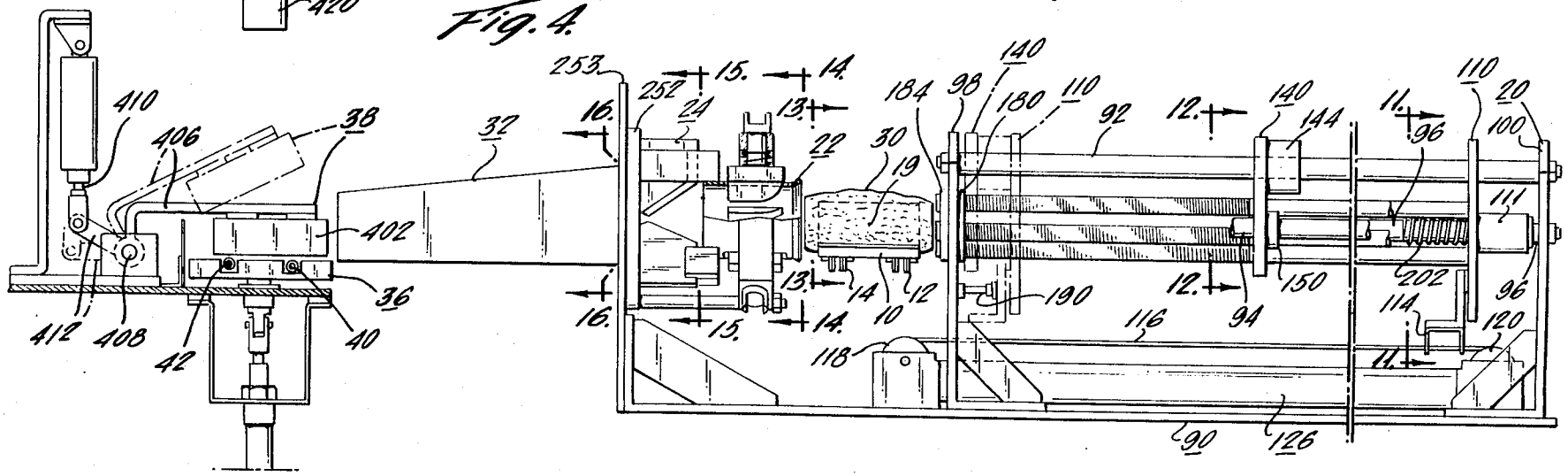
FIG. 4 is an enlarged side view of the pusher mechanism of FIG. 1, including also the cucumber centering means, the knife means for forming the spears, the channel means for delivering the spears onto a platform, and the pivotable spear-guiding means.

During operation of the pusher mechanism 20, the air cylinder 126 first moves the cable 116 to a rearward position for which the rear supporting disc 110 is in its rearmost position, as shown in FIGS. 4–6. For this position, both the solid rods and the flexible rods are in their maximally retracted position, as shown, leaving room for the carrier 10 and the integral cucumber 30 to be moved into the position shown in FIGS. 4 and 5. At a controlled time, the air cylinder is then actuated to drive the rear supporting disc 110 forwardly, driving the solid and the flexible rod members forwardly so that the forward ends of the flexible rod members, and particularly the button-like discs 182, push the cucumber from the carrier through the centering device 22 and the knife means 24 and thence through the channel means 32 onto the platform 36. During this forward motion, the front support disc 140 travels forwardly to the dotted-line position shown in FIG. 4, against the rear of the bushing 180; and the rear supporting disc 110 travels forwardly until arrested by the stop 190 in the position shown also in broken line in FIG. 4. In order to permit the rear supporting disc 110 to pass the stop member 150, a suitably large opening 200 is provided in disc 110 around bar 94. Preferably, in this embodiment, a spiral spring 202 is provided around the central support bar 96 and forward of the rear supporting disc 110, which spring is sufficiently long that its forward end contacts the bushing 180 just before the plate disc is arrested by the stop member 190. At this time the air cylinder 126 tends to reverse the motion of disc 110, but the inertia of the forwardly moving system produces a slight compression of spring 202, which immediately thereafter flexes to its original length thereby providing a degree of spring-return action during the reversal of the direction of motion of the rods.

During the retracting phase of the operation of the pusher mechanism 20, the front support disc 140, due to its frictional engagement with the solid rod members, rides backward with the latter rod members as they are retracted, to be arrested in such rearward motion by the stop member 150. In this manner the disc 140 is caused to provide the desired support of the rod members near the middle of their span in the retracted condition. It will be appreciated that the pusher mechanism in this example has a substantial length, very close to the proportions indicated for it in FIG. 1, and hence it is desirable to provide such rod support near the center of their span, while yet providing that the support can slide forwardly during forward strokes so as not to interfere with the forward stroke of the rear supporting disc 110.

During the forward stroke described above, the rod-restraining disc 184 holds the flexible rod members in fixed relative positions so that they will not tend to bend and splay apart while they are urging the cucumber 30 through the centering device 22 and the knife blades. However, the forward motion of the restraining disc is arrested before the front ends of the flexible rod members enter the channels in channel means 32, so that during their continued forward motion the rod members may splay apart resiliently and assume whatever contours are necessary in urging the cut spears through the twisted channels inside the channel means 32. In this example, the forward motion of the restr ining disc 184 is positively arrested by a group of five set screws such as 220 threaded through, and extending very slightly into the interior of, the centering device 22. During the return stroke, the restraining disc 184 is carried rearwardly by the flexible rods and arrested by end plate 98.

The centering device 22 in this example consists of a metal cylinder 221 having an outwardly flared end for receiving the integral cucumber, and contains a set of five spring-loaded centering strips such as 222, extending radially into the interior of the cylinder 221, at equal angles around its axis; preferably the ends of the centering strips which first receive the cucumber are curved rather than sharp cornered, to provide pressure on the exterior of the cucumber without perforating or scarring it to an undesirable extent. It is also noted that five peripheral scallops are preferably provided around the edge of the rod-restraining disc 184 at positions such as to avoid contact between the aligning strips and the restraining disc as the latter moves through the aligning device. Accordingly, as a cucumber such as 30 is pushed through the centering device 22 by the button-like discs 182 on the front ends of the flexible pusher rods, it is appropriately aligned with the central axis 240 from which the five knife blades 242, 244, 246, 248 and 250 of knife means 24 diverge radially just forward of the outlet end of the aligning cylinder. As a result, the cucumber is cut into five substantially identical spears of sector-shaped cross-section due to the equal dihedral angles between the five blades, as desired. The knife blades in this example are mounted on a ring 252 secured to a vertical support 253, and the five centering strips such as 227 are spring biased inwardly from a ring 254 fixedly spaced and supported from ring 252.

FIGS. 16 through 20 show in detail the manner in which the channel means 32 may be constructed so that the flexible rod members will push the individual spears through the channel means to deliver them upon the support means 36 substantially parallel to each other and with the same corresponding cut-side-down.

Figure 16:
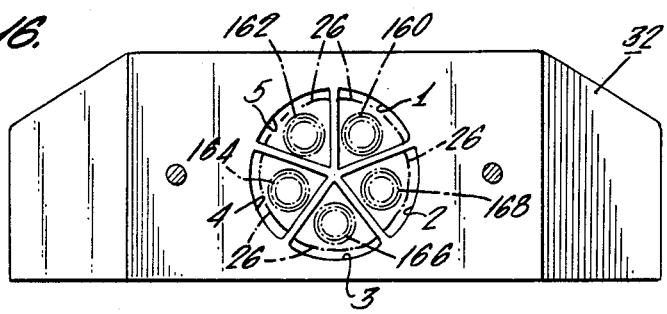
FIG. 16 is an end view showing the inlet end of the channel means, as viewed along lines 16—16 of FIG. 4.
Figure 17:
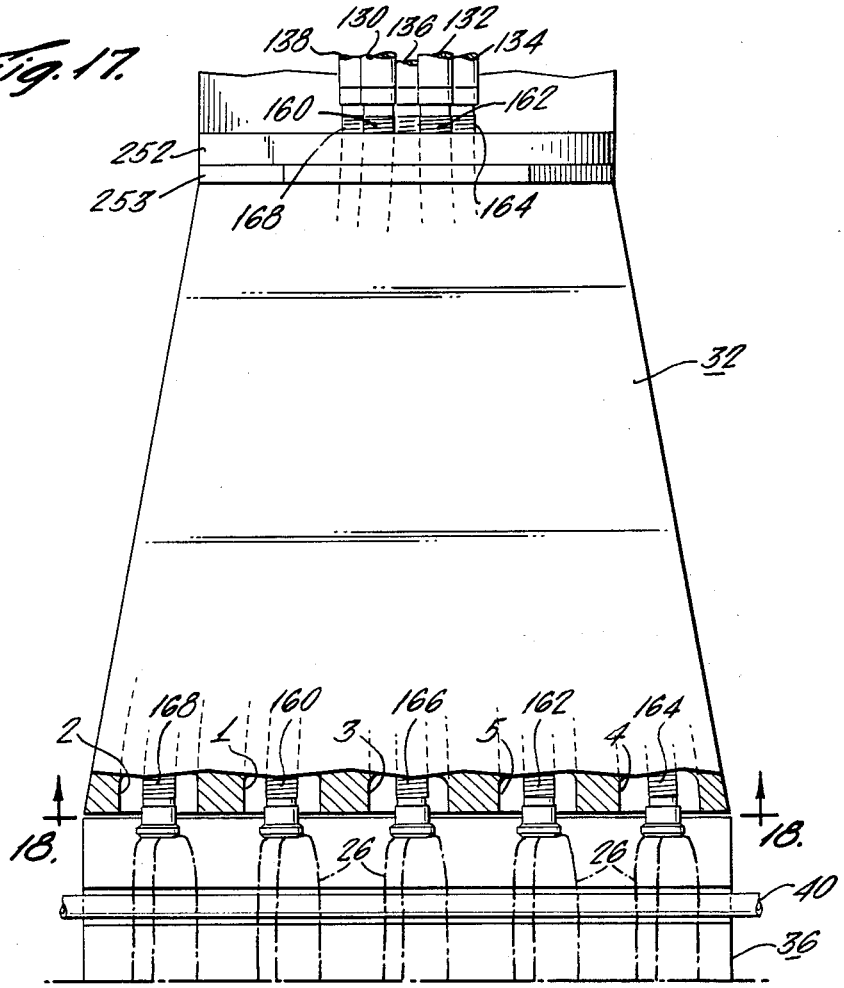
FIG. 17 is a fragmentary top view showing the channel means and a portion of the adjacent support, with the pusher rods extended to deliver the spears onto the platform.
Figure 18:
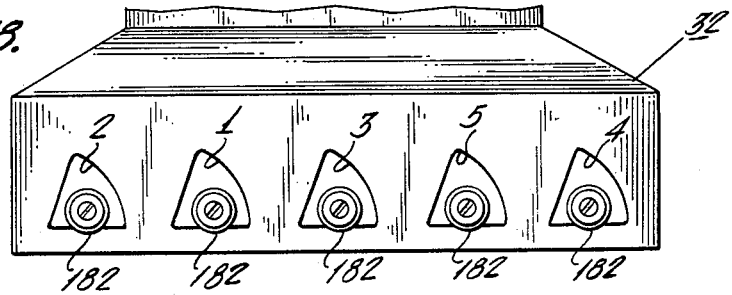
FIG. 18 is an end view showing the outlet end of the channel meas of FIG. 17, taken along lines 18—18.
Figures 19, 20A, 20B, 20C, 20D, 20E, 20F:
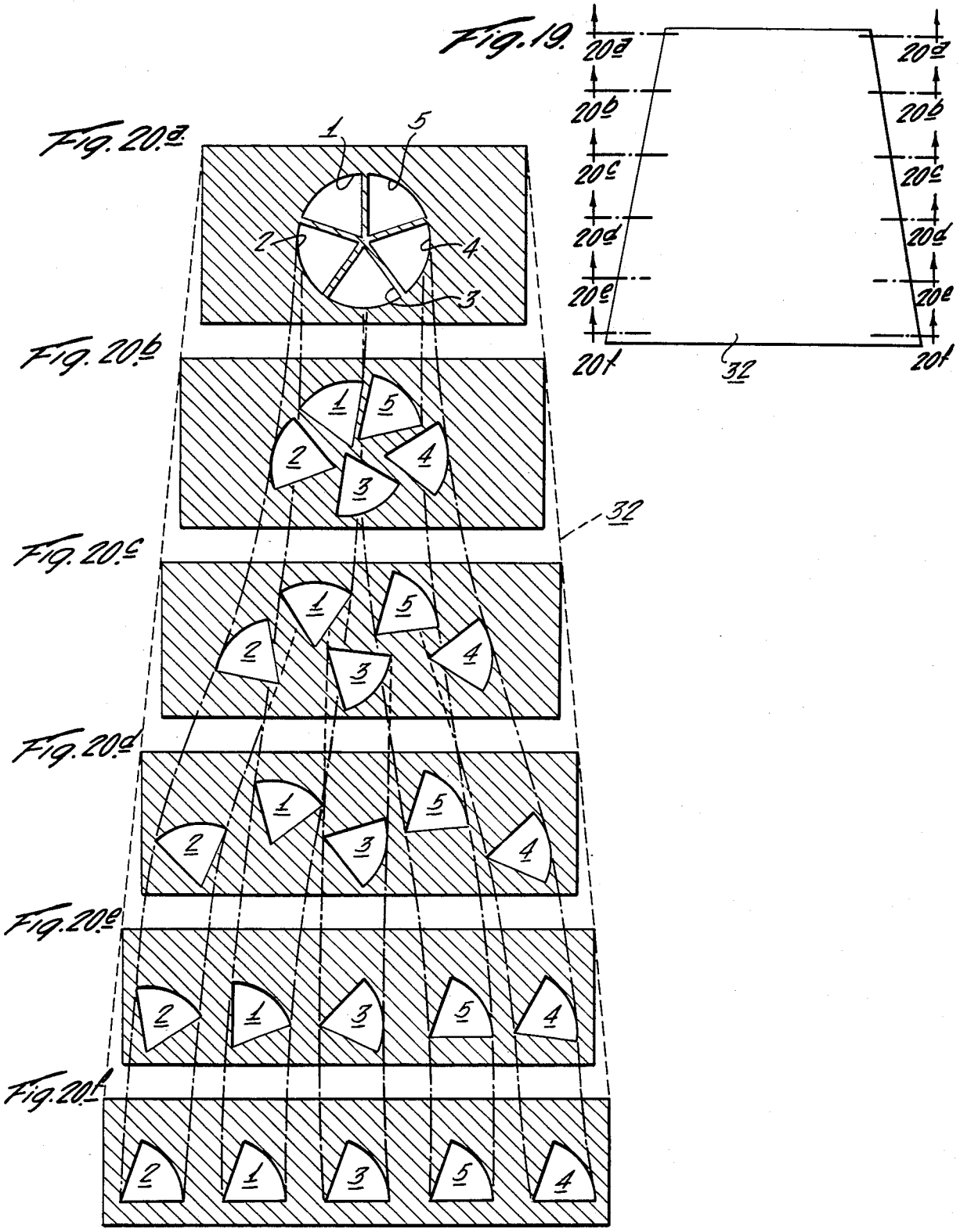
FIG. 19 is a schematic view of the top of the channel means.
FIG. 20*a* through 20*f* are sectional views of the channel means taken at the corresponding positions indicated in FIG. 19.

Thus FIG. 16 shows the input end of the channel means 32, with the positions of the individual spears and of the leading ends of the flexible pusher rod members shown in broken line. FIG. 17 shows the channel means, as view from above, when the flexible pusher rod members have been advanced fully, and the spears delivered onto the platform 36. FIG. 18 shows the outlet end of the channel means and the outlet ends of the five channels numbered 1 through 5 through which the spears are delivered to the support 36. In FIGS. 16 through 20, the corresponding channels have been indicated by corresponding numerals 1 through 5. FIG. 19 and FIGS. **20*a* through 20*f* illustrate the configurations of the channels within the channel means, and the paths which the individual spears traverse in their respective channels. More particularly, FIG. 19 represents schematically a top view of the channel means, and shows the locations at which the six sectional views of FIGS. 20***a* through 20*f* have been taken.

Section 20*a*, accordingly, shows the channels substantially at their receiving ends, where they first receive the cut cucumber spears. The cross-sections of the channels at this point are substantially sectors of a common circle, each somewhat larger than each of the cut spear which it receives and which are pushed through them by the flexible rod members. The successive FIGS. 20*b* through 20*f* show the successive orientations and positions of the channels and spears at points progressively further toward the front of the channel means 32. As will be seen, the effect of the twisting and positioning of the five channels is such that as the channels pass from the inlet end to the outlet end of the channel means, they are twisted and positioned so that at the outlet end they are all at the same horizontal position and in the same orientation. Because the flexible pusher rod members are able to bend transversely, they are able to follow the course of these channels as they push the spears through them to the final discharge position illustrated in FIG. 17.

Although the channels may be provided in a variety of different ways, in the present example they may be made by forming and positioning solid wax bars having sector-shaped cross-sections the same as the cross-sections of the desired channels so that one end of each wax bar is positioned and oriented as in FIG. 20*a*, and the other end is positioned and oriented as in FIG. 20*f*; a metal body portion may then be molded around these solid wax members, and the wax thereafter melted and removed to leave the desired channels.

FIGS. 4 and 5 also illustrate a preferred form of spear-guiding means 38 and spear compacter 44. The spear-guiding means in this example comprises a pivotable array 398 of stalls such as 400, one for each of the cucumber spears, divided from each other by double-walled partitions such as 402. This array is mounted on a support arm 406 pivoted on axis 408, about which it can be pivoted by an actuator 410 and a linkage arrangement 412. In the position shown in full line in FIGS. 4 and 5, the stalls are positioned to receive the spears, one in each stall, and although the spears fit rather loosely into the stalls the stalls provide a guiding function for the spears as they exit from the channel means 32, and assure that they will lie at least approximately parallel to each other on top of the support platform 36.

It will be understood that the completion of the forward stroke of the flexible pusher bars to deliver the spears onto platform 36 is preferably taken as the signal to initiate operation of the actuator 410, so as to lift the stall array to the dotted line position shown in FIG. 4 and so that the spears are free of their stalls and can be moved sideways. This lifting of the stall array is preferably then used as a signal to actuate the compacter 44 so that the actuator 420 thereof executes a cycle in which it first moves a compacter bracket 422 downstream over the top of platform 36, to move the spears toward the downstream end of the platform and into a more closely-packed array of parallel spears. FIG. 22 shows the compacter in its retracted position, and FIG. 23 shows it in its advanced position; in FIG. 23, the position of the compacted set of five spears is shown in full line, whereas the positions of the original upstream two spears, prior to compaction, are shown in broken line.

The spear conveyor belt and platen arrangement is shown particularly clearly in FIGS. 4 and 5, and in enlarged form in FIGS. 22 and 23. In these figures the upstream platform 36 is shown in its raised position where the top of the platform is at or above the top of the spear-conveyor belts 40 and 42, so that the spears can be readily slid from the channel means 32 onto the platform 36.

The platform 36 is vertically positionable by means of an actuating cylinder 500 and a reciprocable actuator 502, whereby upon lifting of the stall array the platform 36 can be moved downwardly a small amount to a lowered position for which the tops of the conveyor belts 40 and 42 are higher than the top of the platform 36, whereupon the spears lie upon the conveyor belts and bridge them, so that they are thereafter carried downstream by the continuously running conveyor belts.

The downstream adjacent platens 50 and 52 are similarly movable between raised and lowered positions for which the spears will be supported upon the tops of the platform or the top of the conveyor belts, respectively. The apparatus for raising and lowering the platens may be substantially the same as for the upstream platform 36.

As shown in FIG. 23, capacity sensors 550, 552 and 554 are preferably provided to produce indications that the first, third and fifth spears, respectively, are present on the conveyor belts directly above the downstream platen 50. When these sensors indicate that all three of the first, third, and fifth spears are thus properly positioned, they produce an output signal which causes the downstream platen 50 to move from its lowered to its raised position shown in FIG. 23, in which the spears are supported on the top of the platform and the conveyor belts are recessed within the platen. Any conventional pneumatic or electrical circuit (not shown) may be used to produce the desired output only when all three capacity sensors are actuated by the presence of spears.

The second group of three sensors 570, 572 and 574 are positioned above the second, or upstream, platen 52 to sense the presence, on the belt above the second platen, of a first, third and fifth spear of the second group of five (the sixth, eighth and tenth of the complete 10-spear array). FIG. 23 shows this next group of five spears positioned on the upstream platform 36 ready to be deposited upon the conveyor belts, and in FIG. 23 this second group of five spears is shown in broken line in the positions which they will assume when they have been conveyed downstream. It is particularly noted that in the condition shown in FIG. 23, the upstream side of the downstream platen 50 extends above the conveyor belts so that the spears of the later-arriving group of five are arrested by abutment against the upstream side of platen 50, and are arrested in the positions shown, on the conveyor belt directly above the upstream platen 52. Accordingly, the fence 46 and the upstream edge of the platen 50 are each required to hold only five spears at a time stationary on the moving conveyor belt, thereby to avoid the problem of buckling of the array of spears whereby they might assume positions or orientation other than those desired, which can arise if for example ten spears are held stationary by a single fence or stop means.

When all three of the sensors 570, 572 and 574 indicate that the first, third and fifth spears of the second group are properly positioned above the upstream platen 52, the latter platen is then automatically raised so its top is at the same vertical position as that of downstream platen 50, resulting in a single horizontal array of ten spears, all parallel and contiguous to each other.

Motion of the second platen 52 to its raised position is preferably used as an indication of the appropriate time at which to initiate a cycle of reciprocation of a spear pusher 600 by an actuating cylinder 602 (see FIG. 1 and FIG. 24). This arrangement may be substantially the same as that illustrated in my above-referenced application, and serves to slide the horizontal array of ten spears sideways from the platens 50 and 52 onto the roll-up belt 58. Retraction of the pusher bar is preferably used as an indication that the actuator for rolling up the roll-up belt with the spears thereon is to be energized. As in my above-referenced copending application, this causes the spears to be rolled up, along with the belt, into a cylindrical array, about a central mandrel 60.

In the particular form of mandrel and pusher cylinder arrangement utilized in this example, there is provided a central fixed support shaft 702 on which the mandrel 60 is slideable from the position shown in full line to the position shown in dotted line within the jar 64. The ring-shaped pusher cylinder 62, provided with appropriate cutouts to enable it to move past various of the elements which would otherwise be on its path, is advanced by the actuator 740 until it picks up snap ring 742 and causes the mandrel 60 to slide forwardly over the center cylindrical support 702 and into the position shown within jar 64; thereafter, on the return stroke of the actuator 740, the cylindrical pusher 62 moves backwardly until it picks up the snap ring 760 and moves the mandrel 60 back to its original position.

Since the operation of the roll-up belt, its guiding means, and the jar advance and discharge arrangements may be as shown in the above-referenced copending application, they are not described further in detail herein.

FIG. 25 illustrates a typical sequence of steps whereby the spears are delivered from the top of the upstream platform 36 into a horizontal array of ten spears on the upraised downstream platens 50 and 52, as will now be described.

Figure 25A:
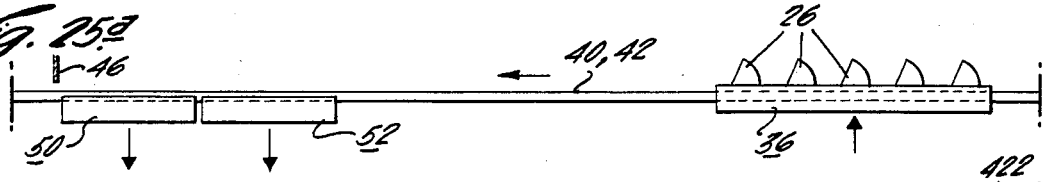
Figure 25B:
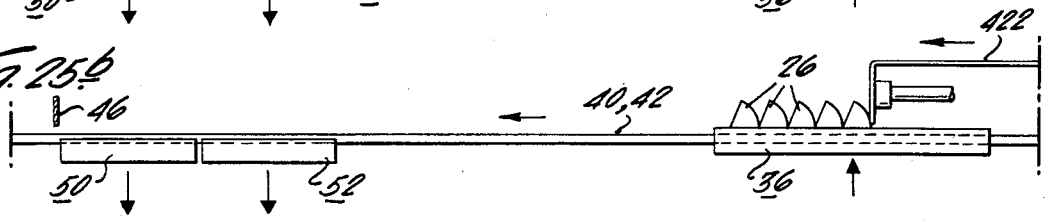
Figure 25C:
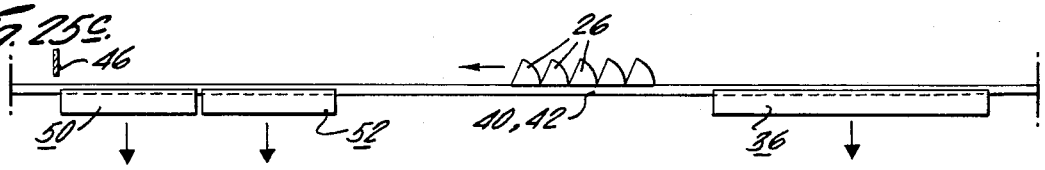

In FIG. 25*a*, the first five spears have been delivered onto the raised upstream platen 36 from the channel means 32 described previously. In FIG. 25*b* the compacter bracket 422 has been advanced to compact or condense the five spears. FIG. 25*c* shows the platform 36 lowered so that this first group of spears rests on the conveyor belts 40,42 and is being carried downstream toward the lowered platens 50, 52 and the fence 46.

Figure 25D:
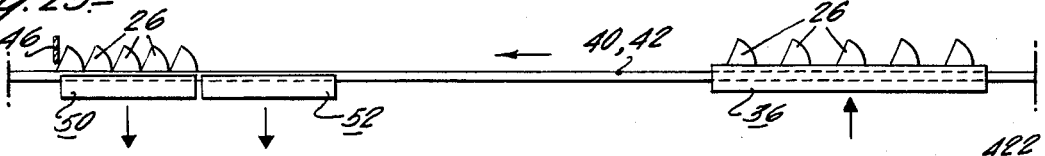
Figure 25E:
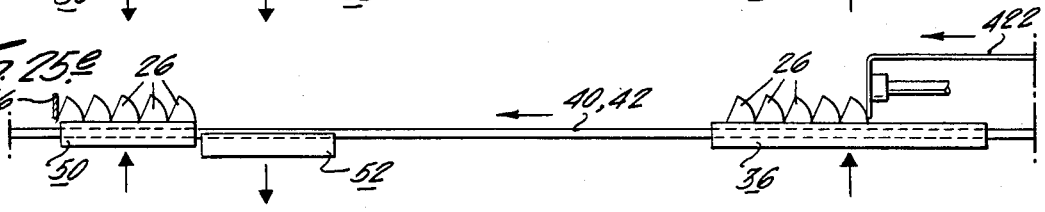
Figure 25F:
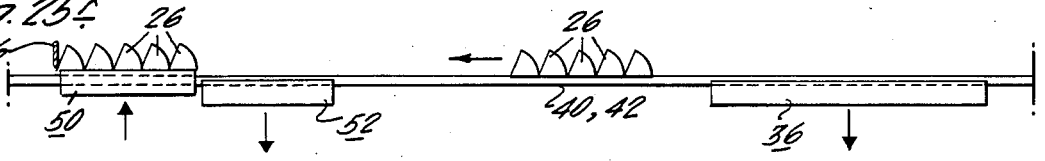
Figure 25G:
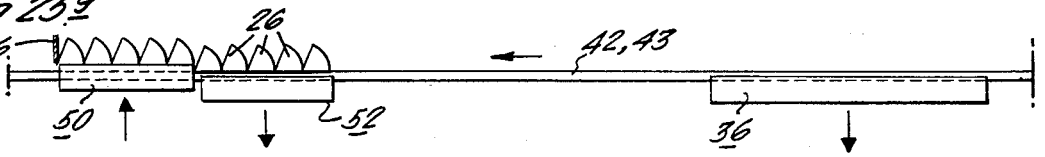

FIG. 25*d* shows the condition in which the five spears have reached the fence 46 and have been arrested above the platen 50, and the next of second group of five spears has been delivered to the now-raised platform 36. In FIG. 25*e*, the platen 50 has been raised to lift the first group of five spears free of the conveyor belts, and the second group of five spears has been compacted or condensed. FIG. 25*f* shows the platform 36 lowered and the second group of five spears being conveyed downstream. In FIG. 25*g*, the second group of spears has been arrested above the lowered platen 52 by the upstream side of the raised downstream platen 50.

Figure 25H:
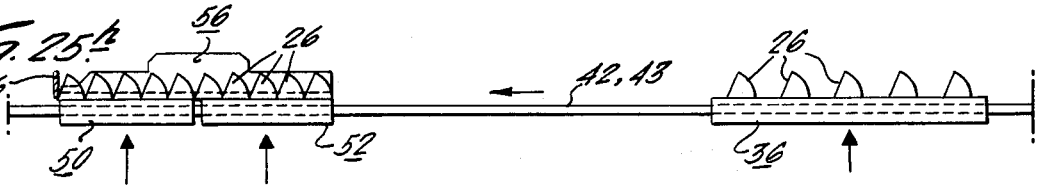
Figure 25I:
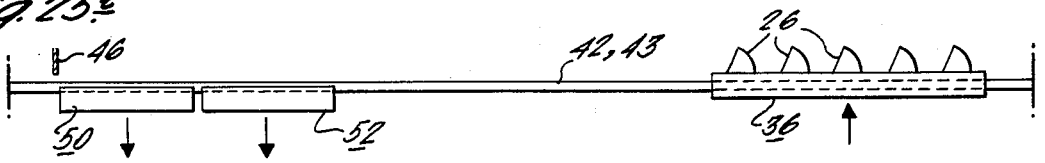

FIG. 25*h* shows the platen 52 raised to lift the second group of five spears free of the conveyor belts and into horizontal alignment with, and contiguous to, the raised first group of five spears. The pusher 56 then advances to push all ten of the spears onto the roll-up belt as described previously. The first five spears of the next group of ten is also deposited on the platform 36, and as shown in FIG. 25*i* both platens 50 and 52 are lowered to begin a new cycle.

For clarity, the array of stalls comprising the pivotable spear-guiding means 38 has not been shown in FIGS. 25*a*–25*i*, but it will be understood that it is pivoted downward into position just above platform 36 just before the pusher rods push the spears out of the guide channels onto platform 36, and pivoted upwards out of the way just before the compacter is operated.

Also, the FIGS. 25*a*–25*i* do not necessarily show the times at which the parts shown first shift to the positions indicated, but instead illustrate the basic preferred order of steps. Just when each step starts depends upon the particular design and adjustment of the apparatus used in a given application, and upon how fast one wishes the apparatus to operate. The timing and actuating circuits and devices for producing the desired sequence of operations may be conventional.

There has thus been provided an effective, fast and accurate method and apparatus for transferring food spears between a conveyor and a platen or platform by raising and lowering of the platform; for forming and delivering food spears onto a platform in predetermined orientations and positions; and for providing a group of arrested food spears on a support means by first arresting a first portion of the group on a moving conveyor, lifting this first portion of the group from the conveyor onto a part of the support means, then arresting the remainder of the group on the conveyor and lifting it into adjacent alignment with the first portion of the group to provide a single horizontal array of contiguous food spears. Also, using these features in combination, a new and advantageous method and apparatus are provided for forming, conveying and arresting food spears in a manner suitable for delivery of the food spears to a spear-packing apparatus.

While the invention has been shown and described with particular reference to specific embodiments in the interest of definiteness, it may be embodied in any of a variety of forms diverse from those shown and described, without departing from the spirit and scope of the invention as defined by the appended claims.

I claim:

1. Apparatus for the forming of food spears from an integral food product, and for delivering the spears onto a support means in predetermined orientations about their longitudinal axes, comprising:

knife means for cutting said food product into spears in response to pushing of said product through said knife means:

flat support means for receiving and supporting said spears;

channel means having a different channel extending therethrough for each of said spears formed by said knife means, each of said channels having an inlet end positioned to receive a corresponding different one of said spears from said knife means and an outlet end positioned to deliver said one spear onto said flat support means;

at least some of said channels being twisted about their respective axes between said inlet and outlet ends thereof so as to change the orientation of the spears about their longitudinal axes as they pass through the twisted channels so that they are delivered onto said flat support means all in the same predetermined orientation about their axes and each parallel to the other and to the flat support means.

2. Apparatus for the forming of food spears from an integral food product, and for delivering the spears onto a support means in predetermined orientations about their longitudinal axes, comprising:

knife means for cutting said food product into spears in response to pushing of said product through said knife means;

support means for receiving and supporting said spears;

channel means having a different channel extending therethrough for each of said spears formed by said knife means, each of said channels having an inlet end positioned to receive a corresponding different one of said spears from said knife means and an outlet end positioned to deliver said one spear onto said support means;

at least some of said channels being twisted about their respective axes between said inlet and outlet ends thereof so as to change the orientation of the spears about their longitudinal axes as they pass through the twisted channels, thereby to deliver said spears onto said support means in a predetermined orientation about their axes different from the orientations in which they leave said knife means;

said apparatus comprising pusher means provided with flexible rod members having forward ends for contacting said spears and reciprocable in and out of said inlet ends of said channels for pushing said spears through said channels onto said support means.

3. The apparatus of claim 2, wherein said flexible rod members comprise one rod member for each of said channels, each rod member positioned and controlled to reciprocate in and out of its corresponding channel.

4. The apparatus of claim 3, comprising spear-aligning means having a plurality of parallel compartments each with an open end aligned with and adjacent to a different one of said channel outlets, said spear-aligning means being movable into a first position over and adjacent said support means, and said compartments each having a dimension transverse to the length of the spears such as to fit loosely about the sides of said spears, thereby serving as aligning stalls to assure that said spears will be delivered onto said support means from said channels in a predetermined parallel relationship to each other, said spear-aligning means being movable away from said position to a second position for which said spears are enabled to be moved from said support means by sideways motion thereof.

5. The apparatus of claim 4, wherein said spear-aligning means is movable between said first position and said second position by pivoting motion thereof.

6. The apparatus of claim 2, wherein said pusher means comprises means for pushing said food product through said knife means.

7. The apparatus of claim 2, wherein said food product is a cucumber, said knife means comprise a plurality of knife blades extending radially outwardly at different angles from a common longitudinal axis to form a plurality of dihedral sectors, each of said inlets of sard channels being aligned with one end of a different one of said dihedral sectors, said support means having a substantially horizontal top surface, said pusher means comprising means for retracting said rod members out of said channels by a distance permitting placement of a cucumber to be cut in the space between said forward ends of said rod members and the adjacent ends of said dihedral sectors, and said apparatus comprising means for advancing said rod members into said inlet ends of said channels after said cucumber has been pushed through said knife means to push said spears onto said support means in said predetermined angular orientations about their respective axes.

8. The apparatus of claim 7, wherein each of said flexible rod members is in the form of an elongated spiral-wound spring.

9. The apparatus of claim 7, wherein said channel means comprises a unitary channel member with said channels comprising openings extending therethrough.

10. The apparatus of claim 7, comprising rod-restraining means slideable on said rod member for holding them in fixed relative positions, means for slideably positioning said rod-restraining means adjacent the forward ends of said rod members as said rod members are advanced toward said inlet ends of said channels, and means for arresting the forward motion of said rod-restraining means while said rod members are advanced into said channels to permit said rod members to change their relative positions as they pass through said channels.

11. The apparatus of claim 10, wherein said rod members and said rod-restraining means are retractable through said knife means to permit placement of said cucumber in a position between the forward ends of said rod members and the inlet end of said knife means, and are advanceable to push the forward ends of said rod members against the adjacent end of said cucumber while said forward ends of said rod members are held in fixed relative position by said rod-restraining means, thereby to push said cucumber through said knife means.

12. The apparatus of claim 11, wherein said arresting means for arresting the forward motion of said rod-restraining means comprises means extending radially inwardly of said knife means to obstruct the forward motion of said rod-restraining means but not the forward motion of said rod members.

13. Apparatus for forming and loading food spears, comprising:

knife means for cutting a set of spears from a food product pushed through it;

spear-receiving means onto which said set of spears is to be loaded;

spear-guiding means having a set of curved channels for receiving said spears individually and for guiding them slidingly into respective predetermined different positions on said spear-receiving means;

reciprocable pusher means for pushing said food product through said knife means and through said separate channels onto said spear-receiving means, said pusher means comprising a plurality of flexible rod members, one for each of said channels, said flexible rod members being adapted to extend into said channels to push each of said spears through the corresponding channel of said spear-guiding means.

14. The apparatus of claim 13, wherein said channels are twisted so as to change the relative orientations of said spears about their longitudinal axis.

15. The apparatus of claim 13, comprising spear-aligning means including a plurality of separate open-ended receiving compartments, each for receiving one of said spears through its open end.

* * * * *

UNITED STATES PATENT AND TRADEMARK OFFICE

CERTIFICATE OF CORRECTION

PATENT NO. : 4,539,879

DATED : September 10, 1985

INVENTOR(S) : Walter W. Egee

It is certified that error appears in the above—identified patent and that said Letters Patent is hereby corrected as shown below:

Col. 3, line 32 "a rested" should be --arrested--.

Col. 15, line 62, "sard" should be --said--.

Signed and Sealed this

*Fifteenth* Day of *April 1986*

[SEAL]

*Attest:*

DONALD J. QUIGG

*Attesting Officer*

*Commissioner of Patents and Trademarks*